United States Patent [19]
Harrigan

[11] 4,382,245
[45] May 3, 1983

[54] LEVITATION DEVICE

[76] Inventor: Roy M. Harrigan, Bromley Mountain Rd., Manchester, Vt. 05254

[21] Appl. No.: 105,239

[22] Filed: Dec. 19, 1979

Related U.S. Application Data

[63] Continuation of Ser. No. 899,733, Apr. 25, 1978, abandoned, which is a continuation of Ser. No. 658,694, Feb. 17, 1976, abandoned.

[51] Int. Cl.³ ..... H01F 7/02
[52] U.S. Cl. ..... 335/306; 46/236; 335/302
[58] Field of Search ..... 335/302, 306; 35/46; 46/236; 308/10

[56] References Cited

U.S. PATENT DOCUMENTS 2,323,837 6/1943 Neal ..... 35/46 R

FOREIGN PATENT DOCUMENTS 642353 8/1950 United Kingdom ..... 335/306

*Primary Examiner*—Harold Broome
*Attorney, Agent, or Firm*—Robert S. Smith

[57] ABSTRACT

A dish-shaped magnet in one form has an upper surface of a first polarity and a lower surface of a second polarity disposed in co-axial relationship to a second magnet having the opposite polar relationships. The magnetic fields in one form of the invention position the second magnet in spaced relation to the dish-shaped magnet. The apparatus has application as a novelty as well as for gyroscopic and other instrumentation apparatus wherein friction must be minimized. The upper magnet may be rotated either manually or by associated apparatus to provide gyroscopic stability.

13 Claims, 4 Drawing Figures

LEVITATION DEVICE

This is a continuation of application Ser. No. 899,733, filed Apr. 25, 1978, which was a continuation of Ser. No. 658,694, filed Feb. 17, 1976, both of which are now abandoned.

BACKGROUND OF THE INVENTION

The invention relates to apparatus for creating levitation and more particularly to magnetic or electrostatic field apparatus to achieve levitation.

It is an object of the invention to provide apparatus which will utilize a repelling magnetic field to support an object.

It is another object of the invention to provide apparatus which produces a magnetic field which facilitates levitation.

It is still another object of the invention to provide levitated apparatus which is stable when positioned in spaced relation above a levitation apparatus.

It is yet another object of the invention to achieve this stability by providing apparatus which will utilize the gyroscopic principles known in the art, counter balancing or various geometric arrangements of interconnected magnets.

SUMMARY OF THE INVENTION

A levitation device includes in one form a first dish-shaped magnet having a concave upper surface uppermost and a first vertical axis which cooperates with a gyroscopic means having a second vertical axis and which includes a second magnet having a polar orientation to repel the concave surface of the first magnet when the first vertical axis and the second vertical axis are coaxial and the second magnet is above the first magnet. In one form the dish-shaped magnet may have a cross-section taken through a vertical plane that is symmetrical about the vertical axis thereof. One or both of the magnets may be a permanent magnet.

In some forms of the invention the apparatus may produce a field having an equal potential concave upper surface having a first vertical axis. A gyroscopic means having a second vertical axis may include a magnet which repels the surface when the first vertical axis and the second vertical axis are coaxial and the gyroscopic means is above the means for producing the field.

Ordinarily the direction of magnetization of a plurality of discrete locations on the dish-shaped magnet define a cone.

DETAILED DESCRIPTION OF THE PREFERRED EMBODIMENT

Figure 1:
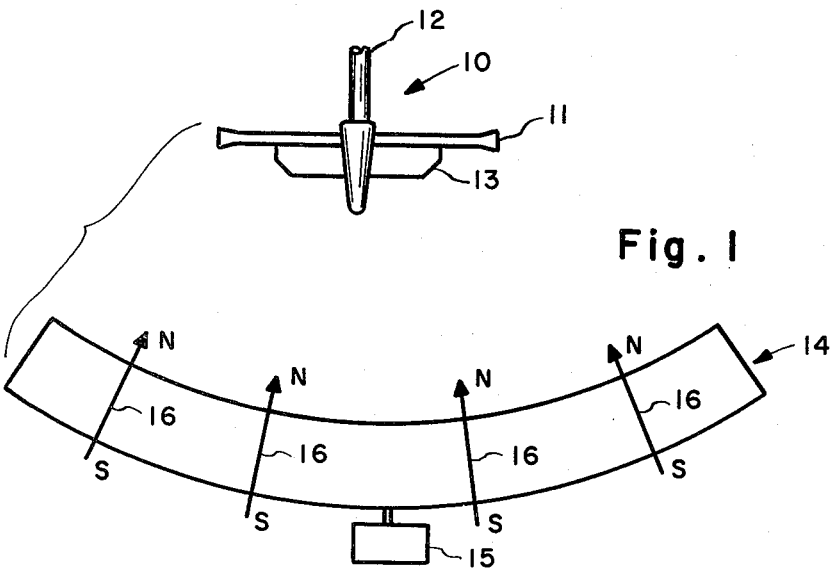
FIG. 1 is an elevational view of the apparatus in accordance with one form of the invention.
Figure 2:
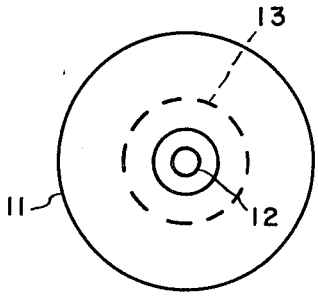
FIG. 2 is a plan view of part of the apparatus shown in FIG. 1.

Referring now to FIG. 1, there is shown a magnetic top assembly 10 disposed above a lower repelling magnet 14. The floating top assembly 10 consists of a non-magnetic elongated member 12, an optional weight or annular member 11 and a magnet 13.

In one form of the invention the entire lower surface of the magnet 13 is of one polarity and the upper surface of the opposite polarity. The direction of magnetization of magnet 14 is shown by arrows denoted by the numeral 16. It will be seen that the arrows 16 converge at a point which is above a point at which the rotor 10 reaches a stable equilibrium operation. Because of this geometric relationship an inward force is imposed on the assembly 10 which tends to limit radial movement. Preferably the cone defined by the arrows 16 will have a diameter at the equilibrium elevational position of the magnet 13 which is greater than the magnet 13 diameter to insure there is a positive inward force.

In other forms of this apparatus each magnet may have a peripheral region of one polarity and central region of the opposite polarity. The central region in each magnet 13, 14 will be of the same polarity and the peripheral regions of each magnet 13, 14 will be of the same polarity. The field lines of the lower magnet 14 in this form of the invention will extend between the peripheral region and the center of each magnet in a generally arcuate form.

In operation of the FIG. 1 embodiment the top assembly 10 is given rotational movement about the axis thereof and positioned above the lower repelling magnet 14 where the magnetic forces will hold it as long as there is continued rotation to insure stability. The top assembly may be spun manually on a piece of aluminum or other non-magnetic material (not shown) initially and thereafter the top moved by means of a conventional mechanism until the top reaches a height where the magnetic field is strong enough to support it. (Various mechanical linkage may be provided for selectively positioning the non-magnetic material at various elevations.) The non-magnetic material may then be removed and the top assembly 10 will be suspended with no visible means of support. It will be understood that the assembly 10 is spun on the non-magnetic sheet and after it stabilizes itself due to gyroscopic effects the non-magnetic material (which as indicated is in sheet form) the assembly 10 and the sheet are lifted upward slowly. With the proper combination of field strengths and elevation the assembly 10 will levitate when the non-magnetic sheet is removed. If the strength of magnet 14 is too great or assembly 10 is not weighted properly, the assembly 10 will rise too high from the magnet 14 and will fall. In this case weights may be added to keep assembly 10 from rising too far. If the magnet is of insufficient strength the assembly 10 will not levitate and instead will sink back to the magnet 14 when the non-magnetic sheet is removed which indicates more strength is needed or weights must be removed from assembly 10. Levitation has been achieved for periods of up to five minutes with proper selection of elements.

The apparatus has application not only as an educational top and novelty but also in other fields such as inertial guidance systems. Those constructions utilizing a peripheral region of inwardly directed lines of magnetization have been found to be stable since the forces created tend to prevent the magnetic top 10 from floating to one side. Similarly, in those embodiments which use the entire upper surface of one polarity, it appears to be preferable that the central region thereof be weaker or lower than the peripheral region to avoid having the top 10 slide to one side. The weight 11 may be selected to prevent the entire top assembly 10 from being lifted away from the lower repelling magnet 14 to an extent where it may readily slide to one side as well as to increase polar inertia to improve stability.

Figure 3:
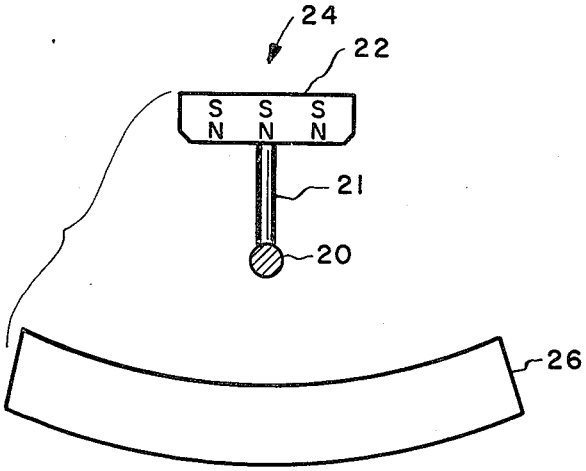
FIG. 3 is an elevational view of another embodiment of the invention which includes a counterweight.

Referring to FIG. 3 there is shown another embodiment of the invention which uses an arm 21 to connect to a mass 20 to a magnet 22. The mass 20 must of course be manufactured of a non-magnetic material. The lower magnet 26 is functionally the same as magnet 14 in FIG. 1. It will be understood that in an alternate construction that the magnet 26 may have a central bore (not shown) to allow the mass to be positioned below magnet 26. In still another form the arm 21 may have a generally U-shaped axial section to allow position of the mass 20 below the magnet 26 without affecting field produced by magnet 26. The U-shaped section may include a generally horizontal member above the magnet 26, a generally vertical section depending therefrom and a generally horizontal section extending under the magnet 26. Various other depending mass structures will be apparent to those skilled in the art. It will be understood that the assembly 24 need not rotate ordinarily to achieve stability since sufficient stability may be achieved by the pendulum effect which is inherent in the described structures. (In various embodiments, however, rotation may be used with counter balancing or geometric relationships.) The assembly of FIG. 3 may be used with a lower magnet such as 14 or 26. Stability is achieved by the geometry of the assembly and rotation is not necessary.

It will be understood that the means to provide rotation of the top 10 may be manual or it may be internal or external rotating means such as air jets or rotary or oscillating magnetic or electric fields. It will also be understood that the lower magnet may be rotated about its vertical axis. In one form a motor may be used and in this form the upper magnet will continue to rotate and float as long as the motor is operated. In this form it may be desirable in some cases that the magnet 11 as well the base be somewhat non-circular or elliptical to facilitate the transmission of torque. It will be understood that in those embodiments such as in FIG. 3 which utilize a counter-weight disposed beneath the upper magnet that the counter-weight may be smaller if the arm which connects it to the rotating magnet is still longer since the weight of the arm and leverage of the mass will be greater. It will be further understood that the lower magnetic field particularly may be created by suitably shaped electro-magnet as well as a permanent magnet.

The permanent magnet 14 or 26 in the preferred form is assembled by providing six flexible laminar magnetic members. In one form the laminations are 0.060" thick and 3" square. Each lamination has a north pole on one side and a south pole on the other. They are stacked with each north pole uppermost and then deformed to the dish-shape shown. A corner elevation of approximately $\frac{3}{8}$" with respect to the center provides an appropriate contour for cooperation with a rotor 10 having a magnet 13 having a 9/32" inside diameter, $\frac{3}{4}$" outside diameter, $\frac{1}{4}$" thickness, a mass of 10 grams and a member 12 having a weight of 5 grams.

The weight 11 is ordinarily necessary to obtain stable operation. The quantity of material in this weight will vary with the density of the material as well as the strength of the fields of each magnet. Ordinarily the rotor 10 will reach stable operation and a height of 1.5" above the magnet 14. The member 12 ordinarily will be manufactured of wood or plastic. A suitable base 15 is provided which will position the magnet 14 so that the axis of the cone defined by the arrows 16 is coincident with the gravitational force imposed on the assembly 10.

Figure 4:
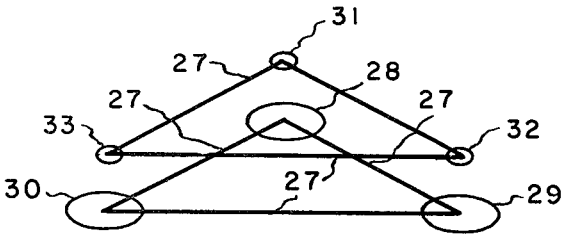
FIG. 4 is an isometric view of another embodiment of the invention which includes discrete interconnected magnets.

Other geometric forms may be used for a single magnet as long as there is a substantially similar direction of magnetization. Still another form of the invention utilizes a plurality of discrete magnets which, for example may be cylindrical and disposed at equal distances from a vertical axis and disposed at equal angular increments about the axis. Each cylinder may have the axis thereof disposed in oblique relationship to the vertical axis to achieve the desired direction of magnetization. It will be further understood that the upper assembly of one embodiment may be used with the lower assembly of another embodiment. The embodiment shown in FIG. 4 includes three magnets 28, 29, 30 of the general type exemplified by magnets 14 and 26. Arms 27 join each of the magnets 28, 29, and 30 in spaced relation. These magnets cooperate with a second set of magnets 31, 32, and 33 also joined by arms 27 to hold the magnets 31, 32, and 33 in spaced relation which is registered with respect the respectively magnets 28, 29 and 30. In this embodiment no revolution of either magnet is necessary to provide stability. It will be understood that any number of individual magnets greater than two may be used.

In those embodiments which do utilize rotation for stability it should be understood that gyroscopic stability may be imparted to a floating magnet by attaching a spinning member to non-spinning floating magnet.

In one form of the invention the lower magnet need not be dished shaped to produce a field having an equal potential concave upper surface and/or lines of magnetization defining a cone. The same magnetic effect may be achieved by the use of a plurality of discrete cylindrical magnets having the axis of each disposed at the same angle to a central axis at the same distance from the central axis. The rotor may also be constructed to produce a field having an equal potential convex lower surface to provide still greater stability. The upper and lower assemblies may be reversed in various embodiments. Although the description herein has utilized magnetic terminology, it will be understood that the term "magnetic" as used herein comprehends field effects including electrostatic phenomena.

Having thus described my invention I claim:

1. A levitation device for cooperation with associated means for producing rotational movement which comprises:

a first dish-shaped magnet having a concave surface uppermost having a first axis;

a second magnet assembly having at least one polar orientation which repels said concave surface;

means for stabilizing said second magnet over said first magnet in spaced elevational relationship with only magnetic fields supporting said second magnet said means for stabilizing comprising an element having a second axis, said element including said second magnet, said second magnet repelling said concave surface of said first magnet when said first axis and said second axis are coaxial and said second magnet is disposed above said first magnet; and said element including means for cooperating with the associated means for producing rotational movement to cause said element to rotate about said second axis relative to said first dish-shaped magnet.

2. The apparatus as described in claim 1 wherein said first dish-shaped magnet has a cross-section taken through any vertical plane that is symmetrical about the vertical axis thereof.

3. The apparatus as described in claim 1 wherein said second magnet is a permanent magnet.

4. The apparatus as described in claim 3 wherein said first magnet is a permanent magnet.

5. The apparatus as described in claim 1 wherein said second magnet is generally planar.

6. The apparatus as described in claim 5 wherein said second magnet is fixed to said means for cooperating and rotates therewith.

7. The apparatus as described in claim 6 wherein said element comprises at least two additional discrete magnets, each magnet in said element being disposed at equal distances from said second axis and with equal angles therebetween measured in a plane which is perpendicular to said second axis.

8. The apparatus as described in claim 6 wherein said element comprises an elongated member having the axis thereof aligned with said second axis.

9. The apparatus as described in claim 8 wherein said elongated member has a center of mass disposed beneath said second magnet and said first axis is aligned with said second axis when said elongated member and said first dish-shaped magnet are disposed in cooperating relationship.

10. The apparatus as described in claim 1 wherein each of said magnets has a peripheral region of the same polarity as the other magnet.

11. The apparatus as described in claim 10 wherein each of said magnets has a central region of the same polarity as the other magnet and opposite to the peripheral region of the same magnet.

12. The apparatus as described in claim 1 wherein said first dish-shaped magnet comprises at least three discrete magnets disposed about said first axis, each of said discrete magnets being disposed with the axis thereof inclined at the same angle to said first axis with the same radial angle therebetween.

13. The apparatus as described in claim 1 wherein said second magnet comprises a plurality of discrete magnets disposed at equal distances about said second axis at equal angular increments.

* * * * *